US007853187B2

(12) United States Patent
Bae

(10) Patent No.: US 7,853,187 B2
(45) Date of Patent: Dec. 14, 2010

(54) IMAGE FORMING APPARATUS WITH SUPPLY UNIT HAVING HIGH APPLIED VOLTAGE

(75) Inventor: Hyun Wook Bae, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 501 days.

(21) Appl. No.: 11/938,941

(22) Filed: Nov. 13, 2007

(65) Prior Publication Data

US 2008/0219711 A1 Sep. 11, 2008

(30) Foreign Application Priority Data

Mar. 5, 2007 (KR) ..... 10-2007-0021611

(51) Int. Cl.
*G03G 15/08* (2006.01)

(52) U.S. Cl. ..... 399/285; 399/281; 399/286

(58) Field of Classification Search ..... 399/281, 399/285, 286
See application file for complete search history.

(56) References Cited

U.S. PATENT DOCUMENTS

2004/0120731 A1* 6/2004 Machida et al. ..... 399/176

FOREIGN PATENT DOCUMENTS

KR 2003-65628 8/2003

* cited by examiner

*Primary Examiner*—David M Gray
*Assistant Examiner*—Joseph S Wong
(74) *Attorney, Agent, or Firm*—Stanzione & Kim, LLP

(57) ABSTRACT

An image forming apparatus including a photosensitive member on which an electrostatic latent image is formed, an image forming unit to form a visible image on the photosensitive member formed with the electrostatic latent image, and a transfer device to transfer the visible image formed on the photosensitive member onto a printing medium. The image forming unit includes a developing agent storage vessel to store a developing agent therein, a developing unit having a conductive layer to which the developing agent is attached and used to attach the developing agent to the photosensitive member, and a supply unit to supply the developing agent stored in the developing agent storage vessel to the developing unit. The developing unit and the supply unit satisfy a relational expression $1.7 \leqq \log Sr/\log Dr \leqq 2.5$, where Sr a volume resistance of the supply unit and Dr is a volume resistance of the developing unit.

14 Claims, 3 Drawing Sheets

IMAGE FORMING APPARATUS WITH SUPPLY UNIT HAVING HIGH APPLIED VOLTAGE

CROSS-REFERENCE TO RELATED APPLICATIONS

This application claims the benefit of Korean Patent Application No. 2007-0021611, filed on Mar. 5, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus, and, more particularly, to an image forming apparatus employing an electro-photographic image forming method, and an image forming unit included in the image forming apparatus.

2. Description of the Related Art

Generally, an image forming apparatus is an apparatus to develop a black-and-white image or color image on a printing medium, such as a sheet of paper, on the basis of an image signal. Examples of image forming apparatuses include a laser printer, an ink-jet printer, a copying machine, a multi-function machine, a facsimile device, etc. Representative image forming methods of these various kinds of image forming apparatuses include an electro-photographic method and an ink-jet method. In the electro-photographic method, a light beam is scanned onto a photosensitive member so as to form an electrostatic latent image, and a toner is attached onto the electrostatic latent image to transfer the electrostatic latent image onto a printing medium. In the ink-jet method, liquid-phase ink is injected onto a surface of a printing medium in response to an image signal.

In an electro-photographic image forming apparatus, more specifically, after the surface of a photosensitive member is electrically charged with a predetermined electric potential, a light beam is scanned onto the photosensitive member so as to form an electrostatic latent image by use of a potential difference, and subsequently, a toner as a developing agent is attached onto the electrostatic latent image, to form a visible image. Then, the visible image formed on the photosensitive member is transferred onto a printing medium, and thereafter, heat and pressure are applied to the printing medium so as to fix the visible image, formed of powder developing agent, onto the surface of the printing medium.

Electro-photographic developing methods may be classified into a unary developing agent method using an insulating toner or conductive toner, and a binary developing agent method using a toner and a magnetic carrier. In the unary developing agent method, toner particles are electrically charged by friction between the respective toner particles or between the toner particles and a charged member, and thereafter, are conveyed onto a photosensitive member by a developing unit. In the binary developing agent method, magnetic carrier particles and non-magnetic toner particles made of a synthetic resin are mixed with each other by an appropriate mixing ratio, and the toner particles are electrically charged while being mixed with the carrier particles. Thereby, after the toner particles are conveyed, along with the carrier particles, onto a magnetic roller, the toner particles are transferred onto a photosensitive member.

Of the above described developing methods, an image forming unit which uses the unary developing agent method includes a developing unit to attach a toner to a photosensitive member formed with an electrostatic latent image, a regulating blade to regulate the thickness of the toner attached to the surface of the photosensitive member, and a supply unit to supply the toner to the developing unit.

The developing unit includes a metallic roller shaft and a rubber conductive layer coupled to an outer surface of the roller shaft, and is installed to come into contact with or to be separate from the photosensitive member. The toner, attached to the developing unit, is conveyed onto the photosensitive member by an electric field generated between the developing unit and the photosensitive member. The regulating blade serves to achieve an even thickness of the toner layer attached to the surface of the developing unit and also, serves to electrically charge the toner attached to the developing unit. The supply unit is made of sponge or urethane foam. The supply unit serves to remove the excess toner, which still remains on the developing unit without being conveyed onto the photosensitive member, while being rotated in contact with the developing unit. In addition, the supply unit serves to attach new toner to the developing unit and also, to frictionally charge the toner attached to the developing unit. Predetermined voltages are applied to the respective developing unit, the regulating blade, and the supply unit.

However, since the volume resistance of the developing unit is changed according to a change of temperature and humidity, the above described image forming unit may cause an unwanted change in the quality of an image when environmental conditions are changed. In particular, under a low-temperature and low-humidity environment (L/L, for example, 10° C. and 20%), the volume resistance of the developing unit increases, resulting in deterioration of toner recovery ability and printing quality.

To solve the above described problem, there has been proposed a method for lowering the volume resistance of a conductive layer included in a developing unit, so as to reduce a change in the volume resistance of the developing unit according to a change of environment. More specifically, if the volume resistance of the developing unit is less than 10E5 Ωcm, the developing unit experiences a slight change in volume resistance under a low-temperature and low-humidity environment (L/L, for example, 10° C. and 20%), a standard environment (N/N, for example, 23° C. and 50%), and a high-temperature and high-humidity environment (H/H, for example, 32° C. and 80%). Accordingly, it is possible to prevent a change in the quality of an image due to only a slight change of the volume resistance.

However, when the volume resistance of the rubber layer, included in the developing unit, is lowered to less than 10E5 Ωcm, it is impossible to achieve a sufficient electric field between the developing unit and a supply unit due to the problem of electric charge leakage. This causes an insufficient amount of toner to be supplied to the developing unit, resulting in a local density difference of an image and consequently, deterioration in the quality of the image.

SUMMARY OF THE INVENTION

The present general inventive concept provides an image forming apparatus in which a rubber layer of a developing unit has a low volume resistance suitable to reduce a change in the volume resistance of the developing unit depending on the change of environment, and a sufficient electric field can be applied between the developing unit and a supply unit so as to achieve a good image quality, and a image forming unit included in the image forming apparatus.

Additional aspects and/or utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an image forming apparatus including a photosensitive member on which to form an electrostatic latent image, a developing unit having a conductive layer and to transfer a developer, and a supply unit to supply the developer to the developing unit, wherein the developing unit and the supply unit satisfy a relational expression $1.7 \leqq \log Sr/\log Dr \leqq 2.5$, where Sr is a resistance of the supply unit and Dr is a resistance of the developing unit.

The conductive layer of the developing unit may have a volume resistance of less than 10E5 Ωcm.

A voltage applied to the supply unit may be greater than a voltage applied to the developing unit.

A conductive layer of the developing unit may substantially include rubber.

The supply unit may include an elastic layer formed to come into contact with the conductive layer and the elastic layer may substantially include urethane foam.

The developing agent may be a non-magnetic unary developing agent.

The image forming apparatus may include a transfer device to transfer a visible image formed on the photosensitive member onto a printing medium.

The foregoing and/or other aspects and utilities of the general inventive concept may also be achieved by providing an image forming unit of an image forming apparatus including a developing unit having a conductive layer formed to attach a developing agent and the developing unit being formed to attach the developing agent to a photosensitive member formed to have an electrostatic latent image, and a supply unit to supply the developing agent to the developing unit, wherein the developing unit and the supply unit satisfy a relational expression $1.7 \leqq \log Sr/\log Dr \leqq 2.5$,where Sr is a volume resistance of the supply unit and Dr is a volume resistance of the developing unit.

The foregoing and/or other aspects and utilities of the general inventive concept may also be achieved by providing a developing device including a photosensitive member to form an electrostatic latent image thereon, a developing unit including a conductive layer to receive a non-magnetic unary developing agent to develop the latent image, and a supply unit to supply the developing agent to the conductive layer as the supply unit and the developing unit are rotatably in contact with each another, wherein the developing unit is supplied with a first voltage and the supply unit is supplied with a second voltage having a greater potential than the first voltage, and wherein a volume resistance of the supply unit is approximately twice as great as a volume resistance of the developing unit.

The second voltage may have a potential approximately 500 v greater than the first voltage.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
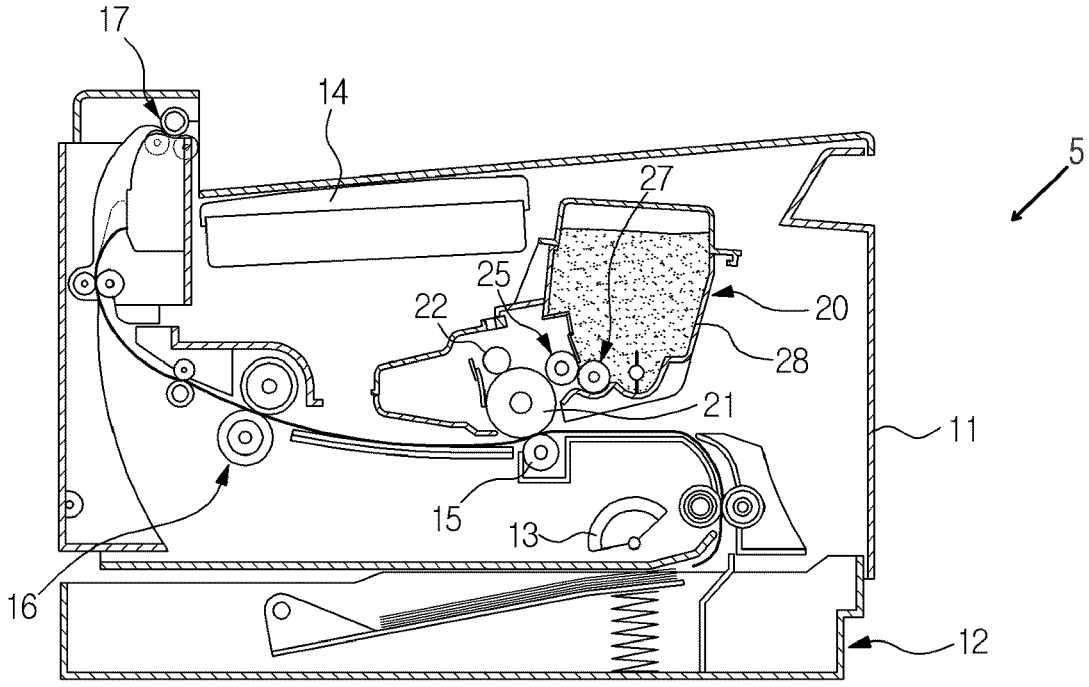
FIG. 1 is a side sectional view schematically illustrating an image forming apparatus in accordance with an embodiment of the present general inventive concept.

Reference will now be made in detail to the embodiments of the present general inventive concept, examples of which are illustrated in the accompanying drawings, wherein like reference numerals refer to like elements throughout. The embodiment is described below in order to explain the present general inventive concept by referring to the figures.

As illustrated in FIG. 1, the image forming apparatus 5 includes a body 11 defining the outer periphery of the image forming apparatus 5, a printing medium loading device 12 in which printing media is loaded, a pickup device 13 to pick up each printing medium, for example a sheet of paper, loaded in the printing medium loading device 12, an image forming unit 20 to form a visible image by use of a developing agent, a light scanning device 14 to generate a light beam responsive to an image signal, a transfer device 15 to transfer the visible image formed on the image forming unit 20 onto the printing medium, an affixing unit 16 to affix the visible image transferred onto the printing medium, and a printing medium discharge device 17 to discharge the completely printed printing medium.

In the image forming apparatus 5 in accordance with the present general inventive concept, if a printing operation begins, the pickup device 13 is operated to pick up the printing medium, loaded in the printing medium loading device 12, one by one, and then the picked-up printing medium is conveyed to the image forming unit 20. In this embodiment, a light beam generated from the light scanning device 14 is introduced in response to an image signal onto the surface of a photosensitive member 21 that was previously electrically charged by an electric charger 22 with a predetermined electric potential, to form an electrostatic latent image. Then, as toner particles are attached to the region of the electrostatic latent image by a developing unit 25, a visible image made of powder developing agent is formed. The formed visible image is transferred onto a surface of the printing medium, and thereafter, is affixed onto the surface of the printing medium while the printing medium passes through the transfer device 15. Finally, the printing medium, printed with the image, is discharged externally from the body 11 of the image forming apparatus 5 by the printing medium discharge device 17.

The above described printing operation is similar to that of a conventional electro-photographic image forming apparatus, and the image forming apparatus 5 of the present general inventive concept includes similar constituent elements as those of a conventional image forming apparatus except for the image forming unit 20. Accordingly, in the following description of the image forming apparatus 5 in accordance with the present general inventive concept, a detailed description of constituent elements other than the image forming unit 20 will be omitted.

Figure 2:
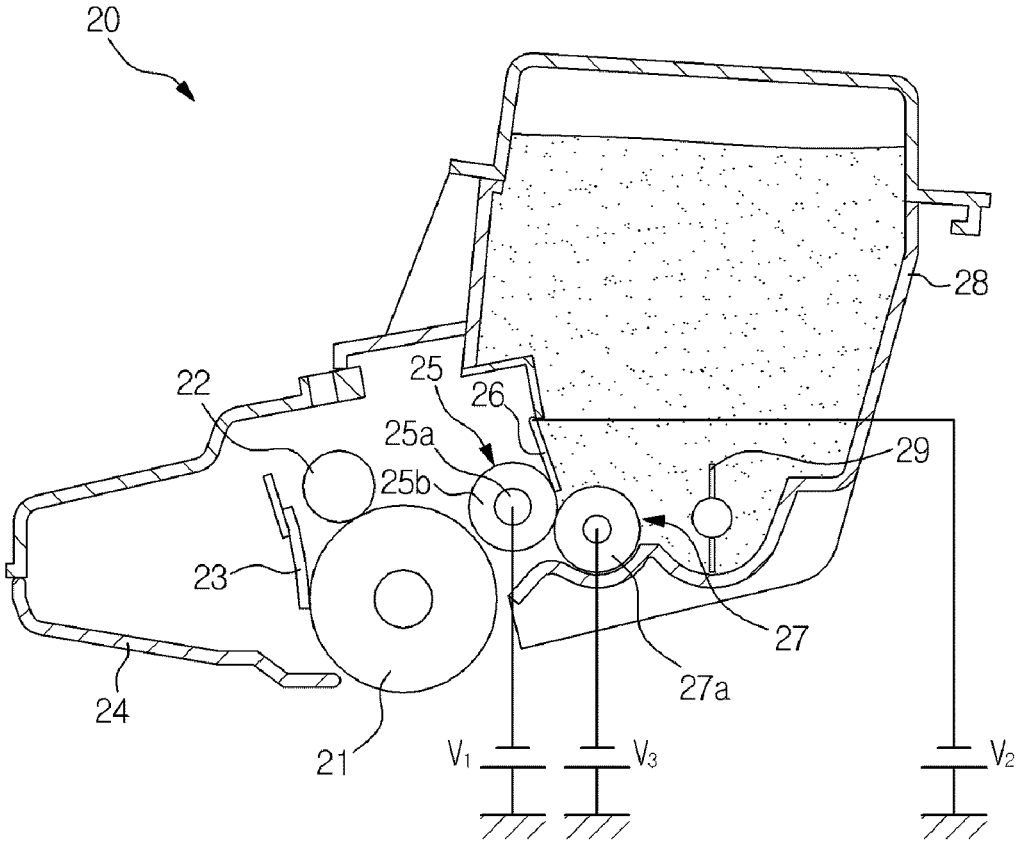
FIG. 2 is a side sectional view schematically illustrating a image forming unit of the image forming apparatus in accordance with an embodiment of the present general inventive concept.

The image forming unit 20 of the image forming apparatus 5 in accordance with the present general inventive concept uses a non-magnetic unary developing agent. As illustrated in FIG. 2, the image forming unit 20 includes the photosensitive member 21 on which an electrostatic latent image is formed, the electric charger 22 to electrically charge the photosensitive member 21, the developing unit 25 to attach a developing agent to the photosensitive member 21, a developing agent storage vessel 28 to store a toner as the developing agent, and a supply unit 27 to supply the developing agent stored in the developing agent storage vessel 28 to the developing unit 25.

A surface of the photosensitive member 21 is electrically charged with a predetermined electrical potential by the electric charger 22. If a light beam, scanned from the light scanning device 14 (refer to FIG. 1), is introduced onto the surface of the electrically charged photosensitive member 21, an electrostatic latent image is formed via the generation of an electric potential difference. Then, a visible image is formed on the surface of the photosensitive member 21 as a toner is attached to the electrostatic latent image. The visible image is transferred onto a printing medium by the transfer device 15. When excess toner remains on the surface of the photosensitive member 21 without having been transferred onto the printing medium, a cleaning blade 23 is operated to separate the excess toner from the surface of the photosensitive member 21. The separated excess toner is collected in a toner recovery vessel 24.

In an embodiment of the present general inventive concept, the photosensitive member 21, electric charger 22, cleaning blade 23, and developing agent recovery vessel 24 are configured as individual elements separable from the image forming unit 20.

The developing unit 25 is formed to come into contact with or be separate from the photosensitive member 21, and a predetermined voltage V1 is applied to the developing unit 25. The toner, attached to the surface of the developing unit 25, is conveyed onto the surface of the photosensitive member 21 by an electric field generated between the developing unit 25 and the photosensitive member 21. The developing unit 25 includes a metallic roller shaft 25*a*, and a conductive layer 25*b* coupled to an outer surface of the roller shaft 25*a*.

In this embodiment, a main component of the conductive layer 25*b* is rubber and the conductive layer 25*b* is fabricated to have a volume resistance of less than 10E5 Ωcm. When the volume resistance of the conductive layer 25*b* is less than 10E5 Ωcm, the conductive layer 25*b* experiences only a slight change in volume resistance depending on a change of temperature and humidity, and thus, an unwanted change in the quality of an image can be prevented depending on a change of environment.

Figure 3:
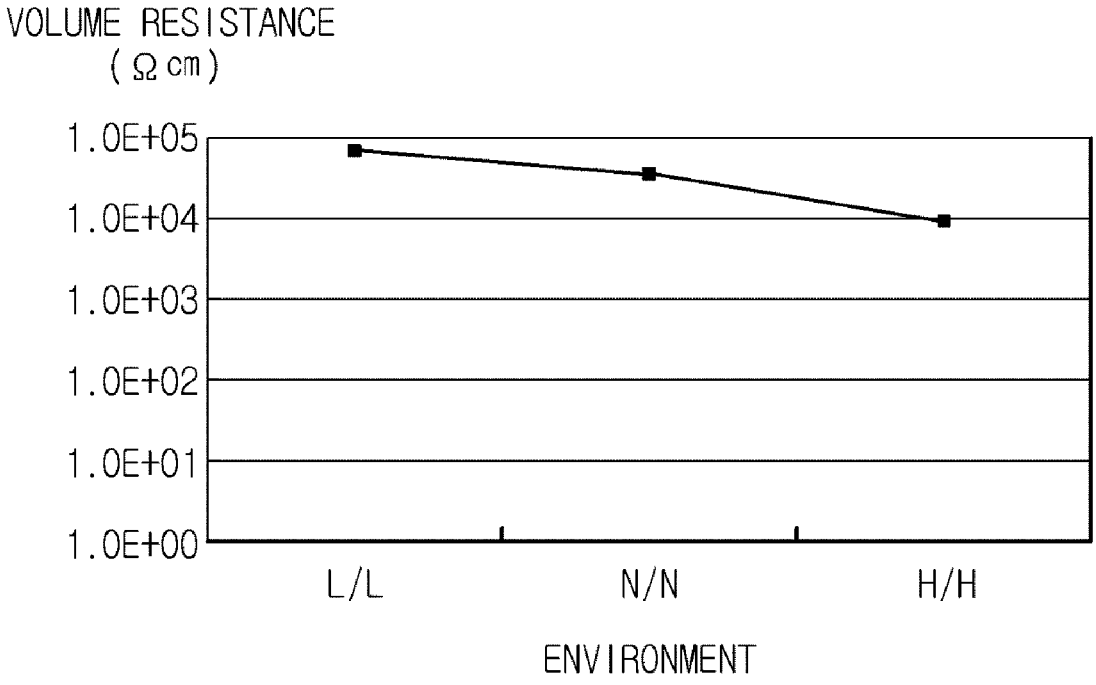
FIG. 3 is a graph illustrating the relationship between the environmental conditions and the volume resistance of a developing unit of the image forming unit of the image forming apparatus in accordance with an embodiment of the present general inventive concept.

As can be understood from the graph illustrated in FIG. 3, when the volume resistance of the conductive layer 25*b* is less than 10E5 Ωcm, the conductive layer 25*b* experiences only a slight change in volume resistance under a low-temperature and low-humidity environment (L/L, for example, 10° C. and 20%), a standard environment (N/N, for example, 23° C. and 50%), and a high-temperature and high-humidity environment (H/H, for example, 32° C. and 80%).

The conductive layer 25*b* can be fabricated to have a volume resistance of less than 10E5 Ωcm by appropriately mixing conductive materials, such as nitrile butadiene rubber having high oil-resistance and wear-resistance, ZnO, TiO2, silver powder, iron oxide, BaSO4, ketjen-black, conductive carbon-black (SAF, ISAF, HAF FEF, GPF, SRF, FT, MT, etc.), etc. In an embodiment of the present general inventive concept, the conductive layer 25*b* may be fabricated to have a thickness of 1~10 mm and a surface roughness of 1~8 μm. In the present general inventive concept, physical properties of the conductive layer 25*b* are not limited to the above numerical values, and can be changed in various manners.

Referring to FIG. 2, a regulating blade 26 is formed in close proximity to a side of the developing unit 25, and is used to regulate a thickness of the toner layer attached to the developing unit 25. The regulating blade 26 comes into contact with the developing unit 25 so as to achieve an even thickness of the toner layer attached to the developing unit 25. The regulating blade 26 is also used to electrically charge the toner attached to the developing unit 25. Similar to the developing unit 25, a predetermined voltage V2 is applied to the regulating blade 26. The magnitude of the voltage V2 applied to the regulating blade 26 is equal to that of the voltage V1 applied to the developing unit 25, so as to prevent an electrical leakage current between the developing unit 25 and the regulating blade 26. The regulating blade 26 is made of an elastic metallic material, such as stainless, beryllium copper, or the like, and can be fabricated to have a thickness of 0.5~1.5 mm. In the present general inventive concept, physical properties of the regulating blade 26 are not limited to the above description, and can be made of a variety of materials with different thicknesses.

The supply unit 27 has an elastic layer 27*a* formed to come into contact with the developing unit 25. A voltage V3, which is higher than the voltage V1 applied to the developing unit 25, is applied to the supply unit 27. The supply unit 27 is formed in the developing agent storage vessel 28 to come into contact with the developing unit 25. A toner agitator 29 to prevent hardening of the toner is also formed in the developing agent storage vessel 28. The supply unit 27 is arranged such that it is rotated while in contact with the developing unit 25, but does not contact the photosensitive member 21, and serves to remove excess toner remaining on the surface of the developing unit 25. The supply unit 27 is also used to supply new toner to the developing unit 25 and to frictionally charge the toner supplied to the developing unit 25. The elastic layer 27*a* of the developing unit 25 may be made of sponge or urethane foam. In an embodiment, the elastic layer 27*a*is made of urethane foam.

The urethane foam can be freely selected from general resins without a special limit so long as the resins have a urethane bond. Polyol and isocyanate are usable as the resin forming the elastic layer 27*a* of the supply unit 27. Examples of the polyol include polyether-polyol, polyester-polyol, polytetra-methylene-ether-glycol, acryl-polyol, polyolefin-polyol, etc. Examples of the isocyanate include TDI, MDA, etc. In addition, a crosslink agent, a surfactant, a catalyst, and a foaming agent are used to form the elastic layer 27*a* of the supply unit 27. The foaming agent may be water or gas.

In addition, other various additive agents may be included in the elastic layer 27*a*. For example, an ion conductive agent, an electron conductive agent, or a conductive polymer material may be included in the elastic layer 27*a* to impart conductivity to the elastic layer 27*a*. Here, examples of an ion conductive agent include perchlorate, ammonium salt, alkali-metal salt, etc. The electron conductive agent includes ketjan-black, acetylene-black, conductive carbon-black (SAF, ISAF, HAF, FEF, GPF, SRF, FT, MT), etc. Examples of a conductive polymer material include polyaniline, polypyrrole, etc. In addition, the elastic layer 27*a* may include a metal oxide, such as natural or artificial graphite, tin oxide, titan oxide, zinc oxide, etc., and a metal powder such as silver or nickel powder.

In the present general inventive concept, the volume resistance of the elastic layer 27*a* of the supply unit 27 is determined based on the volume resistance of the developing unit 25. That is, if the volume resistance of the developing unit 25 is determined to be a certain value less than 10E5 Ωcm, the supply unit 27 is formed of a combination of the above described materials to fulfill the following Relational Expression 1: 1.7≦log Sr/log Dr≦2.5,where Sr is the volume resistance of a supply unit, and Dr is the volume resistance of a developing unit.

In an embodiment where the volume resistance of the developing unit 25 is less than 10E5 Ωcm, assuming that the volume resistance of the developing unit 25 and the volume resistance of the supply unit fulfill the above Relational Expression 1,it is possible to prevent an electric leakage current occurring between the developing unit 25 and the supply unit 27, and consequently, to prevent local density difference of a printed image causing a deterioration of print quality.

The above Relational Expression 1 was obtained by an experiment to actually print an image on a printing medium using a developing unit 25 having a volume resistance of less than 10E5 Ωcm, while changing the volume resistance of the supply unit 27.

The developing unit 25 used in the experiment was made of nitrile butadiene rubber, and had a thickness of 3 mm and a surface roughness of 4~6 μm. The volume resistance of the conductive layer 25*b* was 10E4 Ωcm. The printing result was confirmed based on the density difference of images after repeatedly performing a printing operation on 2,000 sheets of printing media with a coverage pattern of 5% under a standard environment (N/N, for example, 23° C., 50%). In FIG. 2, during a printing operation, the voltage V1 applied to the developing unit 25 is the same as the voltage V2 applied to the regulating blade 26, and has a value of −350V.

The elastic layer 27*a* of the supply unit 27, used in a Version 1 of the experiment, was made of urethane foam having a thickness of 4 mm, and had a volume resistance of 10E6 Ωcm. In this Version 1,the value of log Sr/log Dr was 1.5,and the voltage V3 applied to the supply unit 27 was −850V.

The elastic layer 27*a* of the supply unit 27, used in a Version 2 of the experiment, was made of urethane foam having a thickness of 4 mm, and had a volume resistance of 10E8 Ωcm. In this Version 2,the value of log Sr/log Dr was 2.0,and the voltage V3 applied to the supply unit 27 was −850V.

The elastic layer 27*a* of the supply unit 27, used in a Version 3 of the experiment, was made of urethane foam having a thickness of 4 mm, and had a volume resistance of 10E11 Ωcm. In this Version 3,the value of log Sr/log Dr was 2.8,and the voltage V3 applied to the supply unit 27 was −850V.

The elastic layer 27*a* of the supply unit 27, used in a Version 4 of the experiment, was made of urethane foam having a thickness of 4 mm, and had a volume resistance of 10E11 Ωcm. In this Version 4,the value of log Sr/log Dr was 2.8,and the voltage V3 applied to the supply unit 27 was −1250V, which is higher than the voltage V3 used in Versions 1 through 3.

Experimental results of the above described versions of the experiment are illustrated below in the following Table:

TABLE

| | Version 1 | Version 2 | Version 3 | Version 4 |
|---|---|---|---|---|
| Electric leakage current between developing unit and supply unit | Occurred | None | None | None |
| Image density | Bad | Good | Bad | Good |

As can be understood from the above Table, when the value of log Sr/log Dr is 1.5 as in Version 1 of the experiment, an electric leakage current occurs between the developing unit 25 and the supply unit 27 and an insufficient amount of developing agent is supplied to the developing unit 25. As a result, the resulting image has a local density difference, and consequently, there is deterioration in printing quality.

On the other hand, when the value of log Sr/log Dr is 2.0 as in Version 2 of the, no electric leakage current occurs between the developing unit 25 and the supply unit 27 and the resulting printed image has a good quality without a local density difference.

When the value of log Sr/log Dr is 2.8 as in Version 3 of the, although no electric leakage current occurs between the developing unit 25 and the supply unit 27, the printed image has a local density difference and consequently, there is deterioration in printing quality.

Finally, in Version 4 of the experiment when the voltage V3 applied to the supply unit 27 has a value of −1250V, although the value of log Sr/log Dr is 2.8,the same value as in Version 3 of the experiment, no electric leakage current occurs between the developing unit 25 and the supply unit 27 and the quality of image is improved as compared to Version 3 of the experiment. However, in Version 4,there are problems in that the adaptation of certain elements is required to increase the voltage V3 applied to the supply unit 27 and in that the consumption of electricity increases.

As found from the above versions of the experiment, when the volume resistance of the developing unit 25 and the volume resistance of the supply unit 27 fulfill the above Relational Expression 1,under the assumption that the volume resistance of the developing unit 25 is less than 10E5 Ωcm, it is possible to prevent an electric leakage current from occurring between the developing unit 25 and the supply unit 27 without excessively increasing the voltage to be applied to the supply unit 27, and to achieve the efficient supply of a developing agent to the developing unit 25 resulting in good printing quality.

The image forming apparatus 5 according to embodiments of the present general inventive concept is formed such that the volume resistance of the developing unit 25 is less than 10E5 Ωcm, and the volume resistance of the developing unit 25 and the volume resistance of the supply unit 27 fulfill the Relational Expression 1: 1.7≦log Sr/log Dr≦2.5,where Sr is the volume resistance of a supply unit, and Dr is the volume resistance of a developing unit. Also, when equalizing the voltage V1 applied to the developing unit 25 and the voltage V2 applied to the regulating blade 26 and when increasing the voltage V3 applied to the supply unit 27 beyond the voltage V1 applied to the developing unit 25 by a predetermined voltage (for example, 500V greater than V1), it is possible to prevent a change of image quality due to the change of environment, and to achieve good printing quality by supplying a sufficient amount of developing agent to the developing unit 25 by means of the supply unit 27. These results can be accomplished via regulation in the volume resistances of the developing unit 25 and the supply unit 27.

As is apparent from the above description, according to embodiments of the present general inventive concept, when the volume resistances of both a developing unit and a supply unit are appropriately adjusted under the assumption that the volume resistance of a developing unit is less than 10E5 Ωcm, it is possible to prevent a change of image quality due to a change in environment, and to supply a sufficient amount of developing agent to the developing unit, resulting in good image quality.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a photosensitive member on which to form an electrostatic latent image;

a developing roller having a conductive layer and to transfer a developer; and a supply roller to supply the developer to the developing unit, wherein the developing roller and the supply roller satisfy a relational expression 1.7≦log Sr/log Dr≦2.5, where Sr is a volume resistance of the supply unit and Dr is a volume resistance of the developing unit, wherein a voltage applied to the supply roller is greater than a voltage applied to the developing roller.

2. The image forming apparatus according to claim 1, wherein the conductive layer of the developing roller has a volume resistance of less than 10E5 Ωcm.

3. The image forming apparatus according to claim 2, wherein the conductive layer of the developing roller substantially includes rubber.

4. The image forming apparatus according to claim 3, wherein the supply roller comprises an elastic layer formed to come into contact with the conductive layer and the elastic layer substantially includes urethane foam.

5. The image forming apparatus according to claim 2, wherein the conductive layer receives a developing agent to develop the latent image, and wherein the developing agent is a non-magnetic unary developing agent.

6. The image forming apparatus according to claim 1, further comprising:

a transfer device to transfer a visible image formed on the photosensitive member onto a printing medium.

7. An image forming unit of an image forming apparatus, comprising:

a developing roller having a conductive layer formed to attach a developing agent and the developing roller being formed to attach the developing agent to a photosensitive member formed to have an electrostatic latent image; and a supply roller to supply the developing agent to the developing roller, wherein the developing roller and the supply roller satisfy a relational expression 1.7≦log Sr/log Dr≦2.5, where Sr is a volume resistance of the supply roller, and Dr is a volume resistance of the developing roller, wherein a voltage applied to the supply roller is greater than a voltage applied to the developing roller.

8. The image forming unit according to claim 7, wherein the conductive layer of the developing roller has a volume resistance of less than 10E5 Ωcm.

9. The image forming unit according to claim 8, wherein the conductive layer of the developing roller substantially includes rubber.

10. The image forming unit according to claim 9, wherein the supply roller comprises: an elastic layer formed to come into contact with the conductive layer, and the elastic layer substantially includes urethane foam.

11. The image forming unit according to claim 8, wherein the developing agent is a non-magnetic unary developing agent.

12. A developing device, comprising:

a photosensitive member to form an electrostatic latent image thereon;

a developing roller including a conductive layer to receive a non-magnetic unary developing agent to develop the latent image; and a supply roller to supply the developing agent to the conductive layer as the supply roller and the developing roller are rotatably in contact with each another, wherein the developing roller is supplied with a first voltage and the supply roller is supplied with a second voltage having a greater potential than the first voltage, and wherein a volume resistance of the supply roller is approximately twice as great as a volume resistance of the developing roller.

13. The image forming apparatus of claim 12, wherein the second voltage has a potential approximately 500v greater than the first voltage.

14. The image forming apparatus of claim 12, wherein the developing roller and the supply roller satisfy a relational expression 1.7≦log Sr/log Dr≦2.5, where Sr is a volume resistance of the supply roller and Dr is a volume resistance of the developing roller.

* * * * *